US011897714B2

(12) United States Patent
Rodriguez et al.

(10) Patent No.: US 11,897,714 B2
(45) Date of Patent: Feb. 13, 2024

(54) METHOD AND APPARATUS FOR IMPROVED PAPER TURN UP SYSTEMS WITH CONTROLLED PAPERBAND TENSION

(71) Applicant: Sandar Industries, Inc., Atlantic Beach, FL (US)

(72) Inventors: Peter A. Rodriguez, Jacksonville, FL (US); Craig Austin, Jacksonville, FL (US); Victor Rodriguez, Jacksonville, FL (US); Jason Rodriguez, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 17/965,994

(22) Filed: Oct. 14, 2022

(65) Prior Publication Data

US 2023/0118739 A1 Apr. 20, 2023

Related U.S. Application Data

(60) Provisional application No. 63/273,498, filed on Oct. 29, 2021, provisional application No. 63/256,031, filed on Oct. 15, 2021.

(51) Int. Cl.
*B65H 19/28* (2006.01)
*B65H 23/26* (2006.01)

(52) U.S. Cl.
CPC ..... *B65H 19/28* (2013.01); *B65H 23/26* (2013.01); *B65H 2801/84* (2013.01)

(58) Field of Classification Search
CPC ..... B65H 19/26; B65H 19/28; B65H 23/26; B65H 2801/84
See application file for complete search history.

(56) References Cited

U.S. PATENT DOCUMENTS 2,461,246 A 2/1949 Weyenberg
4,659,029 A 4/1987 Rodriguez
(Continued)

FOREIGN PATENT DOCUMENTS

EP 1026110 A2 8/2000
JP 2783976 B2 8/1998

OTHER PUBLICATIONS

International Search Report and Written Opinion issued in correlated international patent application PCT/US2022/048483 dated Mar. 7, 2023.

*Primary Examiner* — Sang K Kim
(74) *Attorney, Agent, or Firm* — Tracnik Law, PLLC; Joseph P. Kincart

(57) ABSTRACT

Improved apparatus and methods of operating a turn up apparatus on a paper machine to improve the performance of a paper machine turn up process is presented. The apparatus may include a cross track with an internal slot for a paperband to move upon and affixed a surface that is proximate to the first internal slot. The first apron may lie across a surface above a location for the paperband and interact with the paperband when the paperband is pulled out of the apparatus during a turn-up operation. An apron tensioning device may provide an additional force against an edge of a surface of the apron. A curved track may hold the paperband at an angle to an axis of the cross track, and the paperband feeding device may advance the paperband during a portion of a turn-up operation.

17 Claims, 18 Drawing Sheets

(56) References Cited

U.S. PATENT DOCUMENTS

| | | | | |
|---|---|---|---|---|
| 4,757,950 | A | 7/1988 | Rodriguez | |
| 4,783,018 | A | 11/1988 | Rodriguez | |
| 5,046,675 | A | 9/1991 | Rodriguez | |
| 5,417,383 | A | 5/1995 | Rodriguez et al. | |
| 5,453,141 | A | 9/1995 | Rodriguez | |
| 5,467,937 | A * | 11/1995 | Rodriquez | B65H 35/006 242/615.3 |
| 5,472,154 | A | 12/1995 | Qiu et al. | |
| 5,620,544 | A | 4/1997 | Cram et al. | |
| 5,637,170 | A | 6/1997 | Rodriguez | |
| 5,954,290 | A | 9/1999 | Rodriguez et al. | |
| 6,305,634 | B1 | 10/2001 | Rodriguez | |
| 6,405,969 | B1 | 6/2002 | Ogren et al. | |
| 6,416,012 | B1 | 7/2002 | Wilmoth et al. | |
| 6,467,719 | B1 | 10/2002 | Rodriguez | |
| 6,575,395 | B2 * | 6/2003 | Rodriguez | B65H 19/262 242/526.2 |
| 6,578,788 | B2 | 6/2003 | Rodriguez et al. | |
| 7,875,152 | B2 | 1/2011 | Rodriguez | |
| 8,124,209 | B2 | 2/2012 | Rodriguez | |
| 8,178,181 | B2 | 5/2012 | Rodriguez | |
| 8,580,062 | B2 | 11/2013 | Rodriguez | |
| 9,102,491 | B2 * | 8/2015 | Rodriguez | B65H 19/262 |
| 11,459,201 | B2 | 10/2022 | Rodriguez | |
| 2003/0052215 | A1 | 3/2003 | Rodriguez | |
| 2005/0098679 | A1 | 5/2005 | Camp | |
| 2007/0059080 | A1 | 3/2007 | Silverbrook et al. | |
| 2009/0321007 | A1 | 12/2009 | Sekar | |
| 2013/0214077 | A1 | 8/2013 | Jensen | |
| 2014/0021285 | A1 | 1/2014 | Rodriguez | |
| 2020/0101774 | A1 | 4/2020 | Fujiwara et al. | |

* cited by examiner 501
502

509
505
506
507
508

510
511

FIG. 6B
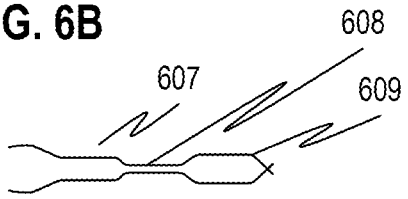
FIG. 6C
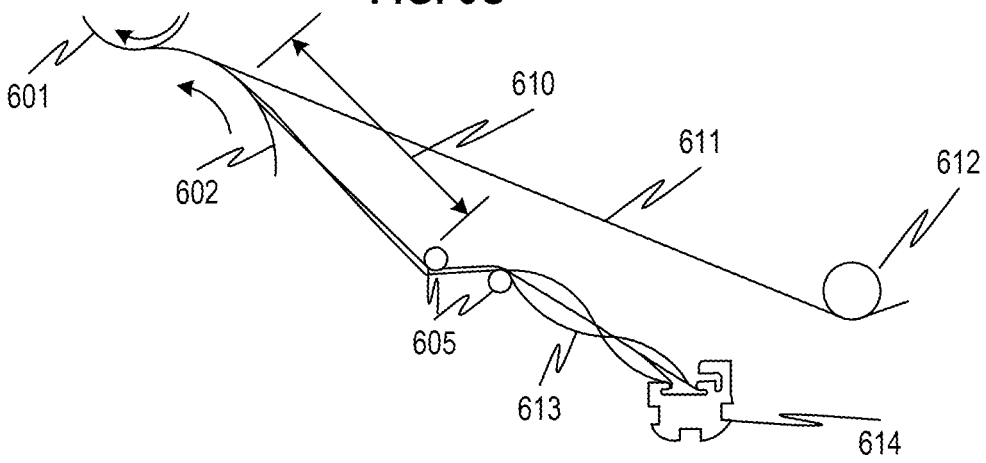
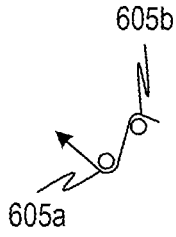
FIG. 6D
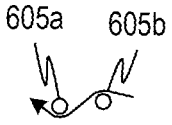
FIG. 6E
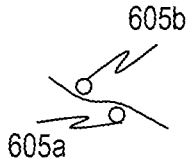
FIG. 6F

METHOD AND APPARATUS FOR IMPROVED PAPER TURN UP SYSTEMS WITH CONTROLLED PAPERBAND TENSION

CROSS REFERENCE TO RELATED APPLICATIONS

The present application claims the benefit of Provisional Patent Application Ser. No. 63/273,498 filed Oct. 29, 2021, and Provisional Patent Application Ser. No. 63/256,031 filed Oct. 15, 2021; the entire contents of each of which is hereby incorporated by reference. The present application makes priority and benefit claims as outlined in the application data sheet; the present application also incorporates by reference in their entirety any matters included in the application data sheet as filed herewith.

INCORPORATION BY REFERENCE TO RELATED APPLICATIONS

The present application references Non Provisional patent Ser. No. 17/407,664, filed Aug. 20, 2021, issued Oct. 4, 2022 as U.S. Pat. No. 11,459,201 B2; and entitled HIGH SPEED PAPER WEB TURN-UP SYSTEM WITH A PREPARED LENGTH PAPER BAND COIL the contents of which are hereby incorporated by reference.

FIELD OF THE DISCLOSURE

The present disclosure relates to methods and apparatus form improved turn up processes on a paper manufacturing machine.

BACKGROUND OF THE DISCLOSURE

The modern industrial paper machine includes a continuous manufacturing process that forms a sheet of paper and winds the newly formed sheet of paper on a steel spindle or spool sometimes coated with a rubber or fibrous sheath and drum spinning with significant force as the paper roll reaches a desired maximum diameter. In order to transfer the collection of the newly formed sheet of paper from a first spool with full roll of paper to an empty spool that will continue to wind the paper requires a turn up process. The turn up process severs the moving paper and transfers it to the empty spool. Typically, a transfer turn up tape is extended across a width of the newly formed paper roll and used to sever the paper.

Modern paper manufacturing is typically performed by producing continuous lengths of paper having widths that may exceed 400 inches, referred to as paper webs, which are wound onto web spools for subsequent converting, storage, transfer, and other processing.

A winding or spooling operation for a paper web, occurs at high speeds which in some cases, exceeds six thousand (6000) feet per minute. In order to maximize production by minimizing downtime and waste, it is desirable to sever and simultaneously transfer a moving paper web from a full spool which may be called a parent roll onto an Empty Web Spool without stopping, adjusting draws (e.g., the speed differential between the incoming and outgoing web rotating support members that are not driven by a common source) or slowing the movement of the web.

Methods and apparatuses for accomplishing this severing and transfer utilizing what is known as a transfer or Turn-Up tape are known. An early example of such a system is shown in U.S. Pat. No. 2,461,246 to Weyenberg, issued in 1949. Other examples are shown in our U.S. Pat. Nos. 4,659,029, 4,757,950, 4,783,018, 5,046,675, 5,453,141, 5,637,170, and 5,954,290. Further examples and detailed discussion of such equipment, systems and methodologies are present in our U.S. Pat. Nos. 4,659,029, 4,757,950, 4,783,018, 5,046,675, 5,417,383, 5,453,141, 5,954,290, 6,467,719, 6,578,788, 7,875,152, 8,124,209, 8,178,181 and 8,580,062, the disclosures of which are incorporated herein by reference.

Deployment of turn-up tape, (sometimes referred to as "paperband"), has constraints on how fast the turn-up tape may be deployed without jamming. Consequently, known turn up processes have inherent risks that diminish efficiency using the paper making machine. Nevertheless, paperband-based turn-up systems for the paper industry have made significant contributions to improving plant efficiency (saleable tonnage), which in turn moderately reduces the plant's environmental impact. It may also be argued that the greatest and most important contribution to the industry by automated turn-up systems is dramatically improved safety for reel section paper machine operators.

The technology of paper making is continually improving and advancing and in general, these advancements increase the level of complexity for performing turn up operations. As a non-limiting example, production is performed on increasingly wider and faster paper machines. Recent efforts to integrate the most advanced paperband-based turn-up systems with these modern paper machines have had mixed results. Thus, the industry is developing a need for even greater sophistication in turn-up systems. It would, therefore, be desired to have a more sophisticated, reliable, and efficient method for supplying turn up paperband during a turn up process.

SUMMARY OF THE DISCLOSURE

In the present invention, the inventors have applied reason and logic to observations of turn-up system operation and performance and described herein a number of improvements.

The present invention provides for improved function, performance and overcoming of shortcomings of paperband-based turn-up systems and to present theory and practice of a paper machine turn-up process.

In one aspect, an apparatus for deploying a paperband for paper machine turn-up operations, the apparatus includes a cross track, where the cross track includes at least a first internal slot for the paperband to move upon and an attaching feature to affix at least a first apron to a surface proximate to the first internal slot, a first apron, where the first apron lies across a surface above the location for the paperband, and where the first apron interacts and contacts the paperband when it is pulled out of the apparatus during the paper machine turn-up operation, an apron tensioning device, where the apron tensioning device provides an additional force against at least an edge of the surface of the first apron, a curve track, where the curve track holds the paperband at an angle to an axis of the cross track, and a paperband feeding device, where the paperband feeding device advances the paperband during at least an initial portion of a turn-up operation.

The apparatus may also include where the attaching feature includes an apron holding slot along the length of the cross track, where the first apron includes a portion of its body that fits within the apron holding slot.

The apparatus may also include an apron tensioning device with a second apron, where the second apron is affixed to the cross track and the second apron contacts the first apron, additional tension is applied to the paperband when the paperband exits the cross track and the paperband contacts a surface of the first apron.

The apparatus may also include where the apron tensioning device includes a bladder. A bladder may be held over a first surface of the first apron and be held in place by a bracket affixed to the cross track. The bladder contacts the first apron and applies additional tension to the paperband when the paperband exits the cross track and contacts a surface of the first apron.

The apparatus may also include where the apron tensioning device includes a bladder, where the bladder is molded to the first apron, and where the attaching feature includes an apron holding slot along the length of the cross track, where the first apron includes a portion of its body that fits within the apron holding slot, and where the bladder contacts at least a portion of the first apron and applies additional tension to the paperband when the paperband exits the cross track.

The apparatus may also include further includes a bar, where the bar has a length approximately equal to a length of a spool of the paper making machine, and where the bar is positioned to be between the cross track and the spool of the paper making machine such that the paperband contacts the bar as the paperband is drawn through a nip.

The apparatus may also include further includes a pair of bars, where the pair of bars has a length approximately equal to a length of a spool of the paper making machine, and where the pair of bars is positioned to be between the cross track and the spool of the paper making machine such that the paperband passes between the pair of bars as the paperband is drawn through a nip.

The apparatus may also include where the cross track further includes a gas system to pressurize at least a portion of the cross track that supports the paperband. Other technical features may be readily apparent to one skilled in the art from the following figures, descriptions, and claims.

In one aspect, an apparatus for deploying a paperband for paper machine turn-up operations, the apparatus includes a cross track, where the cross track includes at least a first internal slot for the paperband to move upon and an attaching feature to affix at least a first apron to a surface proximate to the first internal slot, a first apron, where the first apron lies across a surface above the location for the paperband, and where the first apron interacts and contacts the paperband when it is pulled out of the apparatus during the paper machine turn-up operation, an apron tensioning device, where the apron tensioning device provides an additional force against at least an edge of the surface of the first apron, where the apron tensioning device includes a bladder, where the bladder is molded to the first apron, and where the attaching feature includes an apron holding slot along the length of the cross track, where the first apron includes a portion of its body that fits within the apron holding slot, and where the bladder contacts at least a portion of the first apron and applies additional tension to the paperband when the paperband exits the cross track, a curve track, where the curve track holds the paperband at an angle to an axis of the cross track, a paperband feeding device, where the paperband feeding device advances the paperband during at least an initial portion of a turn-up operation, a pair of bars, where the pair of bars has a length approximately equal to a length of a spool of the paper making machine, and where the pair of bars is positioned to be between the cross track and the spool of the paper making machine such that the paperband passes between the pair of bars as the paperband is drawn through a nip, and where the pair of bars are symmetrically bent in different regions to adjust forces on the paperband as it interacted with at least one bar of the pair of bars.

In one aspect, a method of deploying a paperband for paper machine turn-up operations, the method includes loading a paperband into an apparatus for deploying a paperband for paper machine turn-up operations, where the apparatus for deploying a paperband for paper machine turn-up operations a cross track, where the cross track includes at least a first internal slot for the paperband to move upon and an attaching feature to affix at least a first apron to a surface proximate to the first internal slot, a first apron, where the first apron lies across a surface above the location for the paperband, and where the first apron interacts and contacts the paperband when it is pulled out of the apparatus during the paper machine turn-up operation, an apron tensioning device, where the apron tensioning device provides an additional force against at least an edge of the surface of the first apron, a curve track, where the curve track holds the paperband at an angle to an axis of the cross track, and a paperband feeding device; where the paperband feeding device advances the paperband during at least an initial portion of a turn-up operation. The method also includes activating the apparatus for deploying a paperband for paper machine turn-up operations, where the activating causes the paperband feeding device to advance the paperband.

The method may also include where the apron tensioning device includes a bladder, where the bladder is held over at least a first surface of the first apron and where the bladder is held in place by a bracket affixed to the cross track, and where the bladder contacts at least a portion of the first apron and applies additional tension to the paperband when the paperband exits the cross track and when the paperband contacts at least a portion of a surface of the first apron.

The method may also include where the apron tensioning device includes a bladder, where the bladder is molded to the first apron, and where the attaching feature includes an apron holding slot along the length of the cross track, where the first apron includes a portion of its body that fits within the apron holding slot, and where the bladder contacts at least a portion of the first apron and applies additional tension to the paperband when the paperband exits the cross track. Other technical features may be readily apparent to one skilled in the art from the following figures, descriptions, and claims.

The apparatus may also include where the bladder is connected to a gas control system which may control an inflation status of the bladder.

The apparatus may also include where the bladder is connected to a gas control system which may control an inflation status of the bladder.

The apparatus may also include further includes a positioning system to adjust the location of the bar relative to the cross track.

The apparatus may also include where the pair of bars are symmetrically bent in different regions to adjust forces on the paperband as it interacted with at least one bar of the pair of bars.

The apparatus may also include further includes a positioning system to adjust the location of a first bar of the pair of bars relative to a second bar of the pair of bars.

The apparatus may also include further includes a positioning system to adjust the location of the pair of bars relative to the cross track.

The method may also include where the bladder is connected to a gas control system which may control an inflation status of the bladder.

The method may also include where the bladder is connected to a gas control system which may control an inflation status of the bladder. Other technical features may be readily apparent to one skilled in the art from the following figures, descriptions, and claims.

BRIEF DESCRIPTION OF THE DRAWINGS

FIGS. 6A-6F illustrate aspects of bars for turn-up tape dispensers according to some embodiments of the present invention.

DETAILED DESCRIPTION

According to the present invention, an automated turn-up system program includes methods, devices, features, and elements of an improved turn up apparatus and turn-up process. As mentioned in the following sections, improvements in apparatus and methodology are provided that address observed deficiencies and operational failure modes relating to state of the art turn-up processing technology and methods. Specific examples and embodiments of the improvement are defined herein, however, it is apparent that alternatives and modification of the provided examples that are consistent with the claimed innovations may be obvious to one skilled in the art of paper making which are considered within the scope of the present disclosure.

Glossary

Empty Web Spool: as used herein an Empty Web Spool (sometimes referred to as an Empty Reel, a New Spool, a Reel Spool, Web Spool, or an Empty Spool), includes a spool that paper web being reeled onto a Parent Roll is transferred to. The surface of an Empty Web Spool is commonly used to adhere a transfer tape upon.

Nip: as used here Nip refers to the area where a paper web or sheet is pressed between two rolls/spools.

Full Web Roll: as used herein a Full Web Roll, (sometimes referred to as a Parent Web Roll and/or Old Spool), refers to a web spool that is substantially nearing its capacity for holding paper web.

Paperband: as used herein a Paperband (sometimes referred to as a transfer tape, turn-up tape, Paper Band, or ribbon), refers to a substrate adapted for extending across a longitudinal cylindrical surface of one or both of an Empty Web Spool and a paper bearing web spool (such as, for example a Full Web Spool). The Paperband may include multiple layers.

Reel Drum: as used herein a Reel Drum refers to a spool used to drive movement of a paper web; in some embodiments a Reel Drum may impart rotational movement to a Parent Roll receiving a paper web in a reeling action.

Turn-Up: as used herein, a Turn-Up means a process involving switching a paper web from a nearly completed parent web spool to an Empty Web Spool. A Turn-up process may include severing a paper web from a rotating Full Web Roll nearing its capacity to hold paper, transferring the paper web to an Empty Web Spool, and securing the paper web to the Empty Web Spool.

Figure 1:
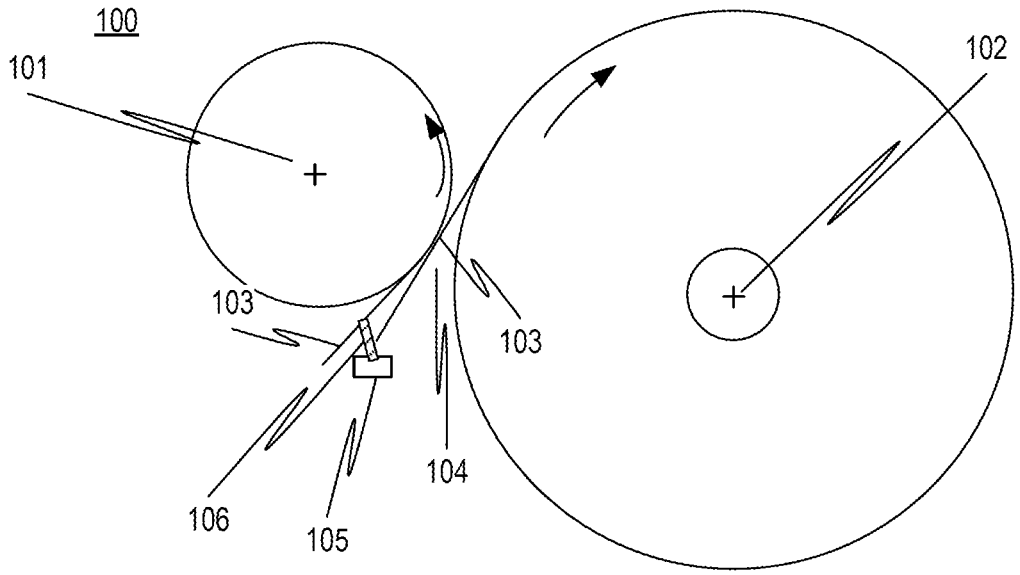
FIG. 1 illustrates a paper processing system with an Empty Web Spool set up and positioned for paper web transfer.

Referring now to FIG. 1, apparatus included in some embodiments of the present invention are illustrated and include an improved paper machine 100. The Empty Web Spool 101 is positioned to take up the paper web 103 as it is moved by the Empty Web Spool 101 in the direction as shown by the arrows. The Empty Web Spool 101 is approaching its capacity to take up the paper web 103.

In an exemplary procedure an operator of a paper making machine 100 with an associated turn-up tape dispensing apparatus (as described herein with reference to FIGS. 1A-8B) may begin with initiation of a load cycle by closing a load switch. The paper making machine 100 may be producing paper and spooling it onto a Full Web Spool 102 which may be nearing a full state.

In some embodiments, a feed of a paperband 105 may be initiated prior to start a turn-up process. In many examples, the feeding of the paperband 105 may be integrated with other control systems on the other portions of the paper making machine 100. Thus, initiation may occur automatically or may occur in response to an operator action such as the pressing of a button. Initiation may cause a feed press (not illustrated in FIG. 1) to pinch the paperband 105.

The feed may cycle to advance the paperband 105 towards an Empty Web Spool 101 that the paperband 105 will attach to. The feed actuator may have a programmed amount of stroke to move the turn-up tape, which may depend on aspects of the paper machine 100 such as, for example, the paper making machine's 100 width and speed.

A sensor may be used to detect an end of stroke of a piston deploying the paperband 105 and the turn-up process may occur, after which the turn-up system may reset to prepare for a next turn-up operation.

In some embodiments of the present invention, a turn-up procedure failure may be caused by one or more adverse conditions, such as, for example, a load position may be closer than optimal to one or more of an Empty Web Spool 101 and a Full Web Spool 102, or an Empty Web Spool 101/Full Web Spool 102 nip 104 for a variety of reasons, such as, for example if adjusted more closely than optimal, if a Paperband 105 extends further than optimal, or other condition that allows for a sequence of mechanical events to occur with less than optimal timing.

For example, if a load position is more close than optimal, during turn-up a paperband may enter a nip 104 between the Empty Web Spool 101 and the Full Web Spool 102 before the actuator completes its cycle. When this happens, the feed Nip may release. A brake may then be applied after the Paperband Empty Web Spool 101/Full Web Spool 102 nip 104 begins to pull paperband 105 from the track. The resulting 'brake delay' may be desirable for the paperband to wrap farther around the spool before applying tension to initiate the turn-up.

In some other conditions, a feed actuator sensor may be positioned beyond the end of an ideal stroke. In such examples, the feed actuator sensor may not detect the piston at the end of an ideal stroke. In the event that the feed actuator fails to detect the piston at the end of the ideal stroke, a control circuit of the turn-up tape distribution system may not change state appropriately, and the feed press may remain engaged. In these examples, the timing may be such that the brake is not engaged. The result may be that the entire length of paperband is pulled through the nip without performing the turn-up.

Alternatively, in some examples, the feed actuator sensor may be positioned before the end of stroke. In such examples, in a typical configuration, the feed press and brake valves may cycle simultaneously and instantaneously as the piston passes the sensor. This action may occur so quickly that neither the press nor brake change state. In some cases, the feed actuator may complete its stroke, and again the brake may not be applied. In such cases, the aberrant result that ensues may be that the entire length of paperband may be pulled through the nip without performing the turn-up.

In some examples, an Empty Web Spool 101 may have been formed, or may wear in such a way that it exhibits crowning, where the thickness at its center is higher than at its edges. In some examples, the Empty Web Spool 101 in use may be designed for other systems to have such a crown. In these non-limiting examples, a result may be that the edges of the paper web may be loose and fluttering which may complicate the turn up. In an extreme case of crowning of the Empty Web Spool 101 surface is excessive, there may not be enough nip pressure to compress the center of the crown and the edges of the Empty Web Spool 101 may not make sufficient contact with the reel drum to pull the sheet and keep the edges taught.

Furthermore, in such examples, even if an Empty Web Spool 101 is contacting a Full Web Spool 102 all the way across, the smaller diameter of the Empty Web Spool 101 ends relative to the Empty Web Spool 101 center may contribute to slack at an edge portion of the web 103 where the spool circumference and surface feet per minute, are lower than at the center. In such examples where edges of the web 103 are so effected, a result may be that the loose edges of the web 103 cause the web 103 to pull out from under the paperband 105.

In some embodiments of the present invention, a situation with loose edges of a web 103 may still complete a turn-up process, but the process will not be performed with optimal control of the torn edge. In some of these examples, the result may be the creation of more wrinkles in the paper web 103 that is spooled.

In some further examples of crowned spools, and particularly for cases of high amounts of crowning, a result may be lowered pressure in the nip area that a paper tape may be applied to. In some examples if the nip 104 is significantly open due to the crowing the adhesive of the paperband when applied to the spool may not firmly adhere to the Empty Web Spool 101. In such examples, the paperband 105 may not follow the Empty Web Spool 101 in wrapping and instead just proceed through the nip 104. The paperband 105 may then just follow and be pulled through the nip 104 without ever wrapping around the spool. In some procedures, where spools are found to have excessive crowning, the spool may be prepared with a wrapping of paper around the spool, such as in a non-limiting sense 2-3 inches of paper, before the spool is used. The result may be less effect of the crowning. In other examples, a procedural step may be to measure spools for crowning and then to reject them if a crown is measured that is greater than a specified range of operability.

Track Curve Adjustments

Figure 1A:
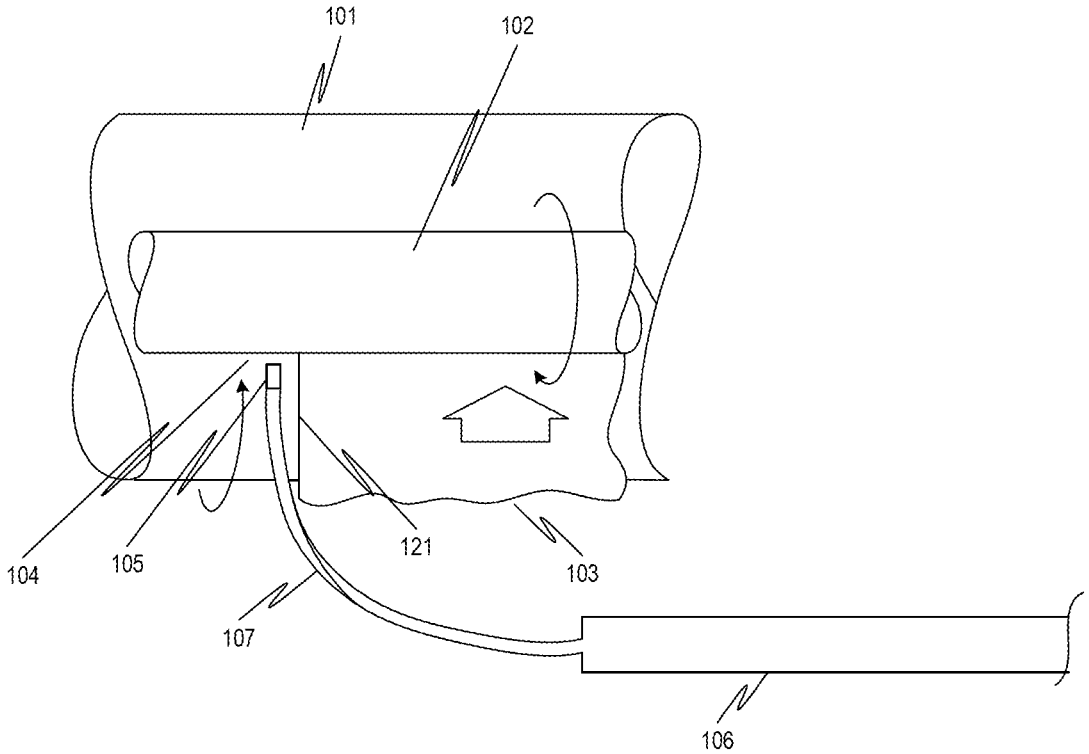
FIGS. 1A-1E illustrate aspects of paperband location for attachment during turn-up of a paperband according to some embodiments the present invention.

Referring now to FIG. 1A, an example of a curve track 107 may be observed. The general components of the paper machine 100 in a plan view perspective may include an Empty Web Spool 101, a Full Web Spool 102, and a paper web 103. The turn-up tape distribution system 109 may include a paperband 105 which may include adhesive applied to its end. A cross machine track 106 of the turn-up tape distribution system 109 may also include a portion of curve track 107. In numerous examples, the shape and position of the curve track 107 may be such that the resulting paperband is positioned parallel to the trim, or perpendicular to the axis of the drum for example. Furthermore, in these examples, the end of the curve track 107 may be located such that it may inject the paperband 105 outside an edge 121 of the paper web 103.

Figure 1B:
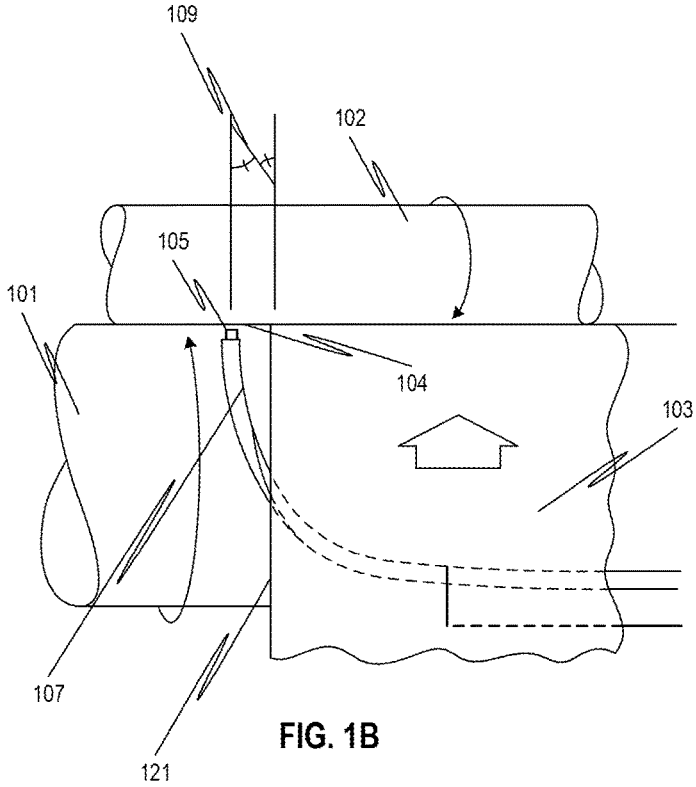

Referring now to FIG. 1B, an elevation view illustrates paper making machine elements and the turn-up tape distribution system 109 elements, an ideal orientation of the paperband 105 as it enters the nip of the Full Web Spool 102 and Empty Web Spool 101 may be as close to parallel as practical compared to the orientation of the paper web 103. In some examples, such an alignment may cause the paperband to exit the curve at the tip first, and the point at which the paperband exits the track progresses down the curve and across the cross-machine track to the exit point and brake.

Figure 1C:
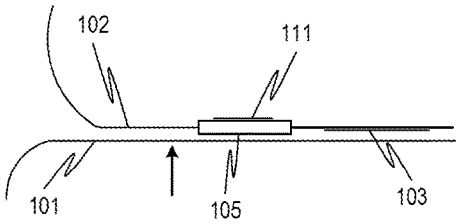

Referring now to the inset of FIG. 1C, a close up view of a paperband 105 in its initial phases of a turn-up operation is presented. As shown, the Full Web Spool 102 and Empty Web Spool 101 may be close together to form a nip 104. In the nip 104, the paperband 105 may be attached to the Full Web Spool 102 with adhesive 111. As illustrated, the paperband 105 may lie outside of the paper web 103.

Figure 1D:
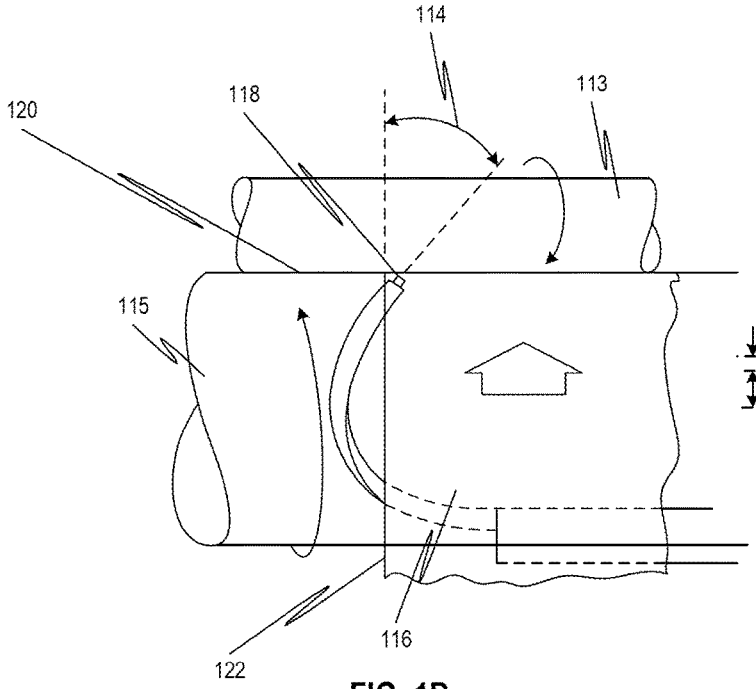

A different set of ideal conditions may occur when turning up thicker papers. In some examples for thicker papers, it may be desirable to turn the tip of the curve in toward the paper web to inject the paperband into the nip on top of the paper. Referring now to FIG. 1D an illustration of examples for thick paper is provided. Since the example is different from the previous types of examples, the elements have different reference numbers, however, it is likely that some the elements may be similar or the same as elements referred to in the examples of FIGS. 1A-1C.

Again, in reference to FIG. 1D, an empty spool 113 and a full spool 115 may be brought together to form a nip 120 into which a paperband 118 may be injected. A thicker paper web 116 may be in the process of being formed on the paper machine, and a different curve setting may be used to feed the paperband 118 onto the empty spool 113.

Figure 1E:
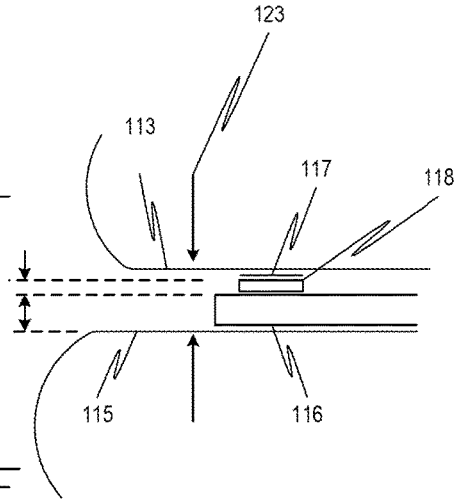

In the illustration of FIG. 1D, the angle 114 at which the paperband 118 may be pointing with reference to the edge 122 of the thicker paper web is illustrated. In addition, it may be apparent that the paperband 118 may be positioned under the thicker paper web 116 not to the side as in other examples. The inset of FIG. 1E illustrates this with an empty spool 113 and a full spool 115 forming a nip 123. The thicker paper web 116 may have the paperband 118 and adhesive 117 lying between the thicker paper web 116 and the surface of the empty spool 113. In some examples, if the angle 114 of injection of the paperband is too severe, the paperband may pull taught and pops out of the belly of the curve. In these examples, the lower point of exit may then advance along the cross-machine track and at some point, the band may pull out of the tip of the curve.

Flutter of Paperband on Turn-Up

In studies of various conditions of paperband based turn-up operations, video recording of the turn-up on a fast paper machine can show various aspects. For example, under certain conditions the paperband may be observed to flutter as it is moved, and in some examples this fluttering may cause it to twist as it enters the nip. Under this condition, where the paperband is fluttering, this may cause a twist in the paperband as it enters the nip. In some examples, the flutter may result in compressing the folded or twisted paperband in the nip and weakening it sufficiently that it breaks, which may cause the turn-up is missed. In some of these examples a solution that has been demonstrated includes examples where the curve has a larger radius, and the tip is more parallel to the trim, although it is still pointed in to land the paperband on the web. The effect of the realignment may be to smooth the band's exit from the track, encouraging it to pull out of the tip of the curve first and discouraging it from popping out of the belly of the curve.

Figure 2A:
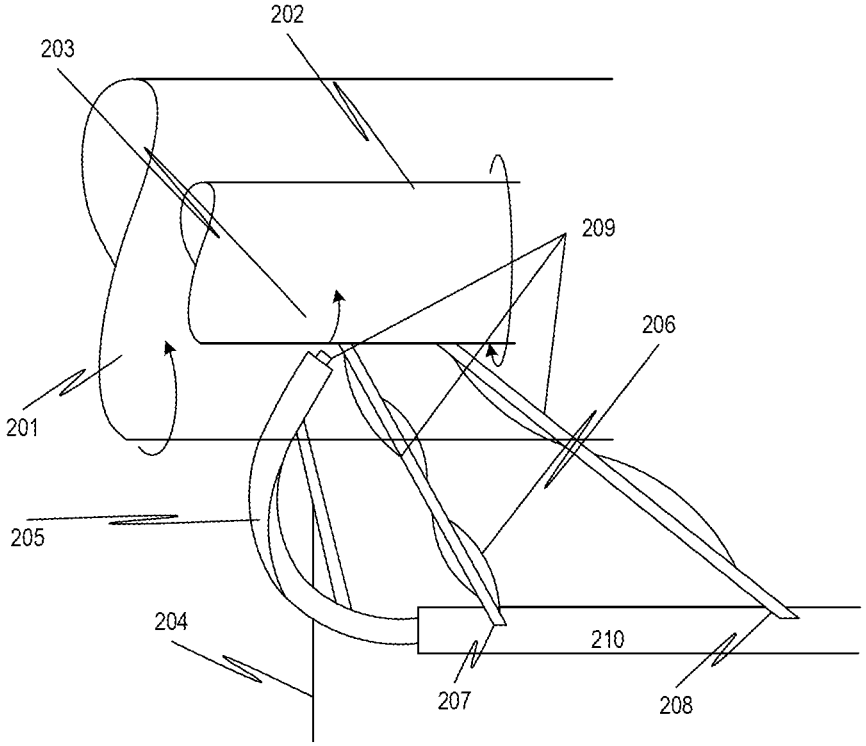
FIGS. 2A-2B illustrate aspects of paperband attachment and evolution during turn-up of a paperband along with sensitivities according to some embodiments the present invention.

Referring to FIG. 2A an example with flutter is illustrated. As in previous examples for thick paper webs, the paperband 209 may be inserted at a high angle 203 to the edge 204 of the paper web where the Full Web Spool 201 and the empty web spool 202 are as illustrated. With such a high angle 203 of the curve 205, the paperband 209 may immediately pull out of the curve 205 and then introduce flutter 206 as may be observed as the paperband 209 proceeds down the track 210 from a first point 207 to a second point 208.

Figure 2B:
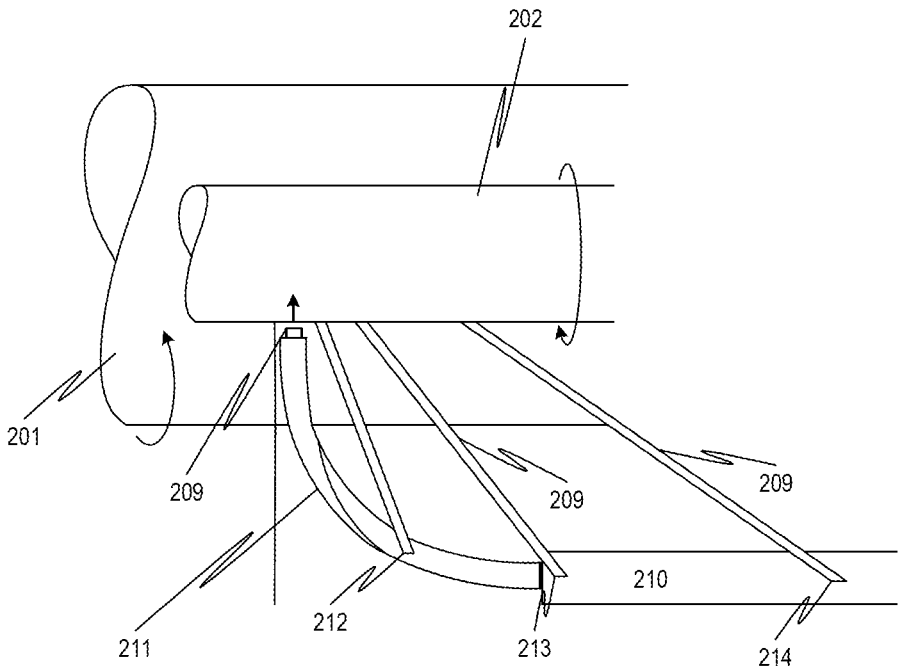

In reference to FIG. 2B, some additional embodiments are illustrated. The Full Web Spool 201 and an empty web spool 202 are the same as illustrated. The paperband 209 may be inserted into a high radius curve track 211 and may be placed more parallel to the trim of the system. The result may be that as the paperband 209 is pulled during a turn-up procedure, the paperband 209 exits the high radius curve track 211 more smoothly as the paperband 209 proceeds from a first position 212 through a second position 213 and to a third position 214 without the introduction of flutter.

Grooves and Band Tension

Figure 3A:
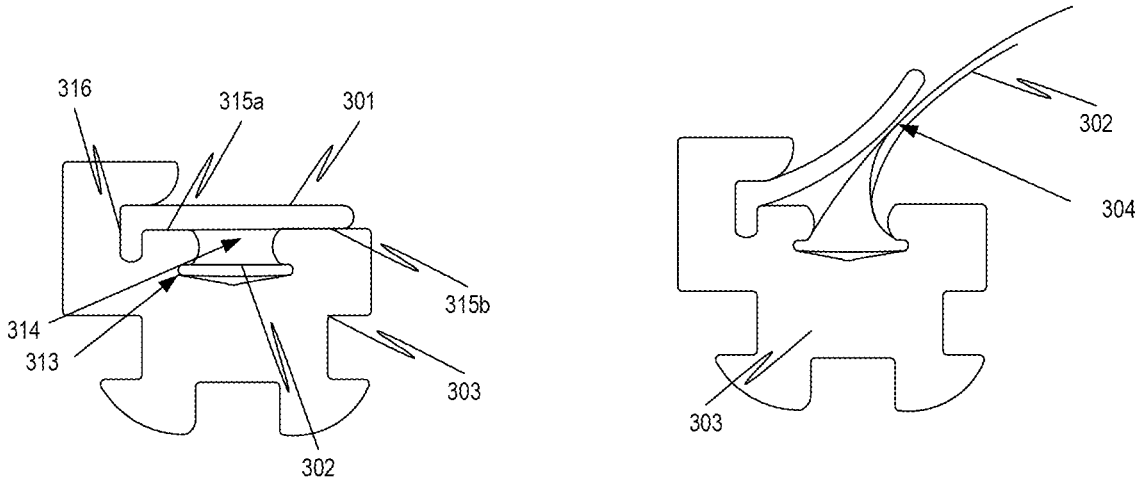
FIGS. 3A-3D illustrate aspects of tracks for turn-up tape dispensers according to some embodiments the present invention.
Figure 3B:
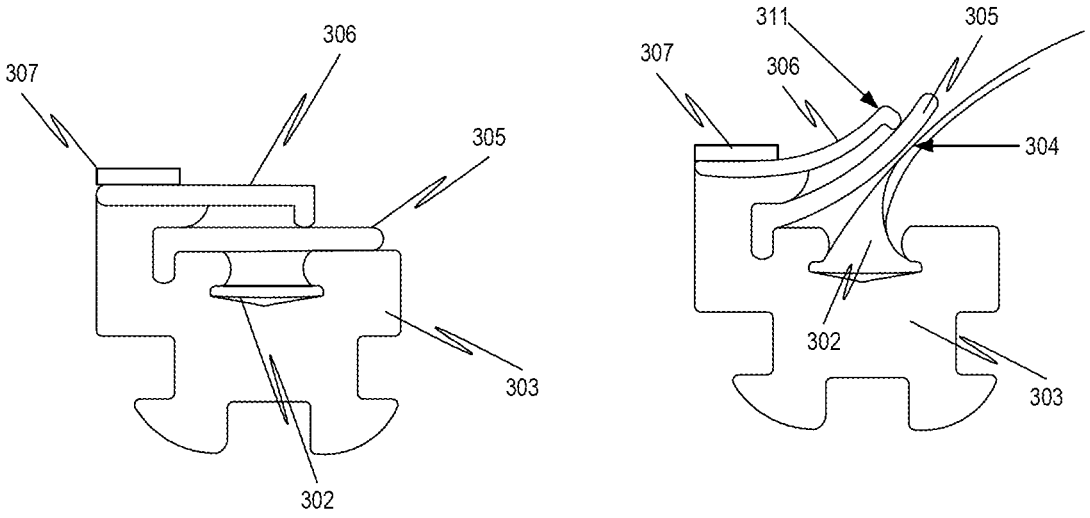
Figure 3C:
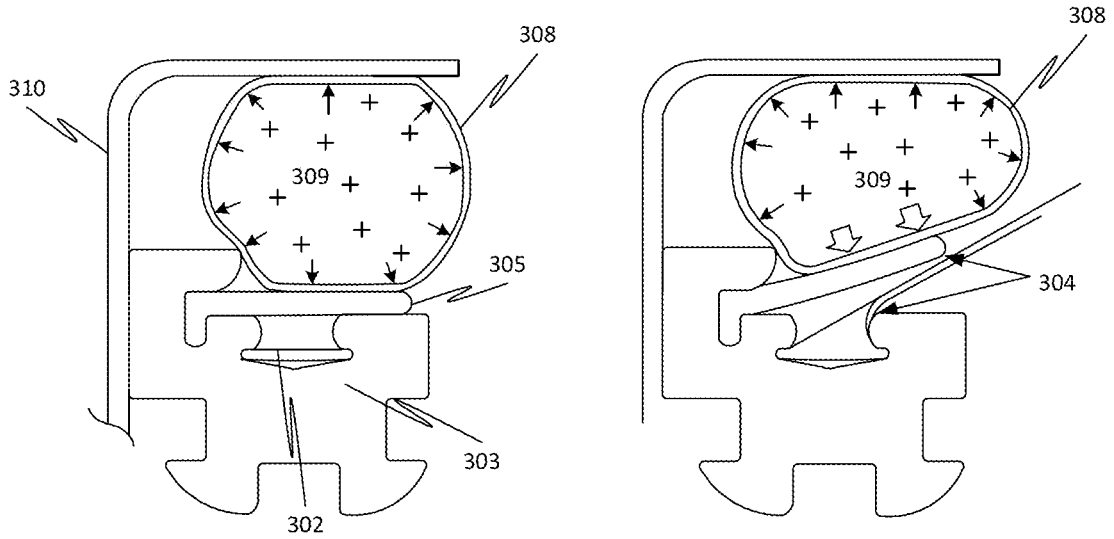

Referring now to FIGS. 3A-3C, during the use of paper producing machine, wear may be introduced into various components. In an example, grooves may form by various processes in the reel drum with use. In some examples, these grooves may tend to spiral out to the edges of the reel drum from the center, and these grooves may have the effect of impeding the progress of the paperband across the paper until it passes the center of the machine, at which point the grooves tend to favor the progress to the near side.

Under a scenario where grooves impede progress of a paperband across the width of the paper web, it may be important that tension is developed in the paperband. For example, if no tension were developed in the paperband, it may be pulled from the end of the curve without advancing at all. By introducing conditions which apply tension to the paperband the result may be to cause the paperband to seek the shortest path between where it has entered the nip and whatever is applying the resistance, whether it be the track or brake of the paperband dispensing device. In many examples, the insertion point is located outboard of the point of resistance, and in these examples, the shortest line may lie at an angle to the drum-spool nip. This angle may cause the tearing of the paper to advance across the web while also encouraging the paperband to move across the width of the spool and drum as the paperband is consumed in the nip.

Several elements of the turn-up system and process may contribute to the generation of tension in the paperband between its exit from the track and the spool-drum nip. For example, the role of tension may include providing the force to pull the paperband longitudinally through the track. The tension may also provide the force to peel the paperband out of the curve, which may be called curve pull-out. The tension may also provide the force to peel out the paperband out of the track which may be called track pull-out. The tension may also provide the force to pull the paperband through the break.

In some examples, a force to pull a paperband through the track may be affected by a length of the track and/or a severity of a curve portion of a track. Furthermore, a force to pull a paperband through the track may be affected by the presence, or absence of moisture in the track coupled with how long the paperband is left in the track. Moreover, the force to pull the band through the track may be affected and by the accumulation of debris in the track. The thickness and width of the Paperband may also contribute. The force required to peel the paperband out of the track may also be affected by the stiffness of the paperband, the angle at which the band is leaving the track, and the speed of the paper machine.

Standard track may be provided with an apron that protects the exit of the paperband from the track from debris and moisture. It also provides for a degree of control over the Paperband exit from the track.

FIG. 3A, illustrates a cross section view of a cross track 303 (sometimes referred to as a transverse track) with a first apron 301. As illustrated, as the Paperband 302 leaves the cross track 303, the Paperband 302 interacts with the first apron 301. The first apron 301 provides a frictional force 304 to the Paperband 302, as the Paperband 302 moves across the first apron 301 exiting the cross track 303. The first apron 301 may be in contact with a first transverse track surface 315*a* and a second transverse track surface 315*b* to cover the transverse opening and thereby exclude debris and/or other contaminants that may be in an ambient environment surrounding the cross track 303 until such time that a turn-up process is executed and the paperband 302 is deployed and exits the cross track 303.

FIG. 3B illustrates some alternative designs of a cross track 303 that include a second apron 306 providing increasingly more downward pressure 317 as a first apron 305 and a second apron 306 are increasingly forced away from the cross track 303. Additional downward pressure 317 induces additional friction 304. One or both aprons 305-306 may be held down by a clamp 307 positioned to provide a securing force. A force required to pull the paperband 302 from the cross track 303 can be increased by installing this second apron over the first.

Referring now to FIG. 3C an addition of a track tensioning device 310 (illustrated as a bracket) which applies adjustable pressure to the first apron 305. A pressurized bladder 308 may be held in a position above a relatively standard apron 309. When the forces of the system begin to withdraw the paperband and lift the apron 309 it may compress the pressurized bladder 308 which will increase the force that the apron applies to the withdrawing paperband. In some examples, the pressurized bladder may be connected to a controllable aas control system so that dynamic changes of the pressure in the bladder may be affected. In a non-limiting example, the pressure may be increased if a different processing condition motivates a changed pressure or if operational performance on prior turn-up operations indicate a desired change in the pressure on the apron.

Figure 3D:
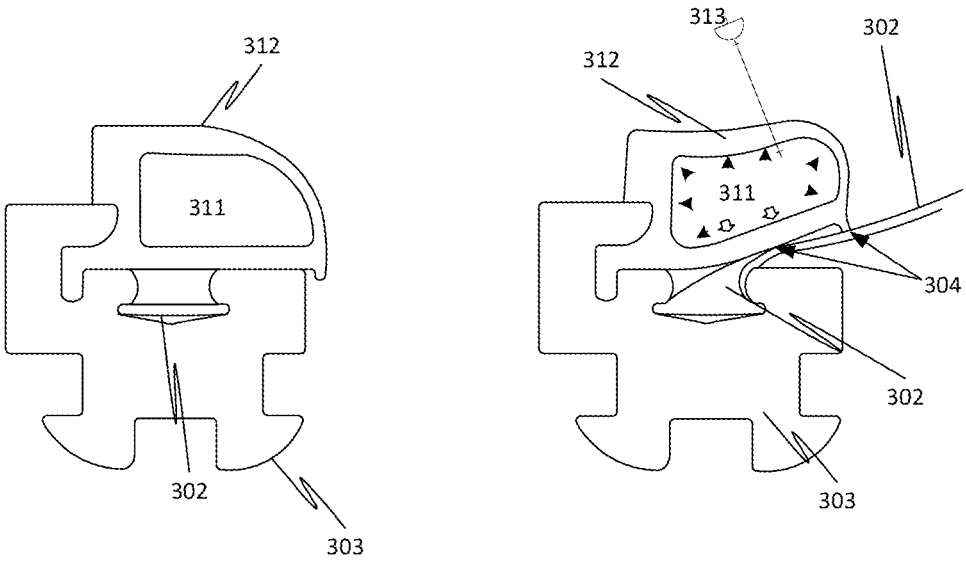

Referring now to FIG. 3D, a version of a pressurized bladder apron device is illustrated. In some examples, the pressurized bladder apron device may be a single unit 312 incorporating a surface like an apron into a body that contains an envelope for contained gas. The single unit 312 may also include features that allow it to attach into the track 311 without the need of additional clamping features or the like. Such a design may be considered self-fixing. In some examples, the self-fixing bladder with integral apron and drip edge may include a fixed pressurization in the bladder. As with other examples, the pressure within the body of the bladder may also include examples which may be regulated by a gas control system so that adjustments may be made to the pressure in the bladder.

Increasing the tension may tend to increase the angle at which paperband exiting a cross track 303, and, therefore, may contribute to a more controlled advance of the paperband exiting across the paper machine. A greater angle may shorten the free length of the paperband between the track and the nip, reducing flutter and twisting.

An apparatus for deploying a paperband for a turn-up operation on a paper making machine, the apparatus including a cross track 303, including a first internal slot 318, in which a paperband 302 may be extended to prepare for a turn-up procedure on the paper making machine and a transverse opening 314 through which the paperband 302 may be deployed. A first apron 301 positioned above the transverse opening 314 and contacting a first transverse track surface 315*a*, and a second transverse track surface 315*b* may be used to form a seal against debris entering the first internal slot. The first apron 301 may be transversally flexible such that as the paperband 302 exits the first internal slot 318 and is being removed from the cross track 303 during a turn-up operation, the first apron 301 applies frictional force resisting the paperband 302 as it exits the cross track 303.

As the high radius curve track 211 holds the paperband at an angle to an axis of the cross track, the paperband feeding device may be operative to advance the paperband through the first internal slot 318 without exiting the transverse opening 314. A clamp 307 may affix a first apron 301 across the transverse opening 314.

In some embodiments, the clamp 307 includes an apron holding slot 316 along a length of the cross track 303. The first apron 301 will include a portion that fits within the apron holding slot 316 such that the apron holding slot 316 fixedly attaches the first apron 301 to the cross track 303.

In some embodiments, an apron tensioning device (may be embodied as a second apron 306) may provide an additional force generally normal (e.g., within ten degrees of 90 degrees) to an upper surface of the first apron 305. While a force that is not normal to the upper surface of the first apron 305, more force may be required to create an optimal resistance to the paperband deployment than a normal force.

In some embodiments, a second apron 306 may be affixed to the cross track 303 and contact the first apron 301 thereby providing additional tension to the paperband when the paperband exits the cross track 303 and contacts the surface of the first apron 305. Still further, apparatus of the present invention may include a bladder 308 positioned above the first apron 305 and beneath the track tensioning device 310, wherein the bladder 308 is resistant to compression and movement of the first apron 305 compressing the bladder 308 results in pressure generally normal to a top surface of the first apron 305. Some additional embodiments include a gas control system 313 in fluid communication with the bladder 308. The gas control system is operative to be capable of providing pressurized gas to the bladder 308 and control an inflation status of the bladder 308.

In some embodiments, a bladder 308 may be positioned above the first apron 305, and the attaching feature may include an apron holding slot 316 in the cross track 303. The first apron 305 may include a portion that fits within the apron holding slot 316, and the bladder 308 will contact at least a portion of the first apron 305 in a manner that allows the bladder 308 to exert a force in a generally normal direction against the first apron 305. Still further, in some embodiments a gas control system 313 may be connected in fluid communication with the bladder 308 to control an inflation status of the bladder 308.

Figure 4A:
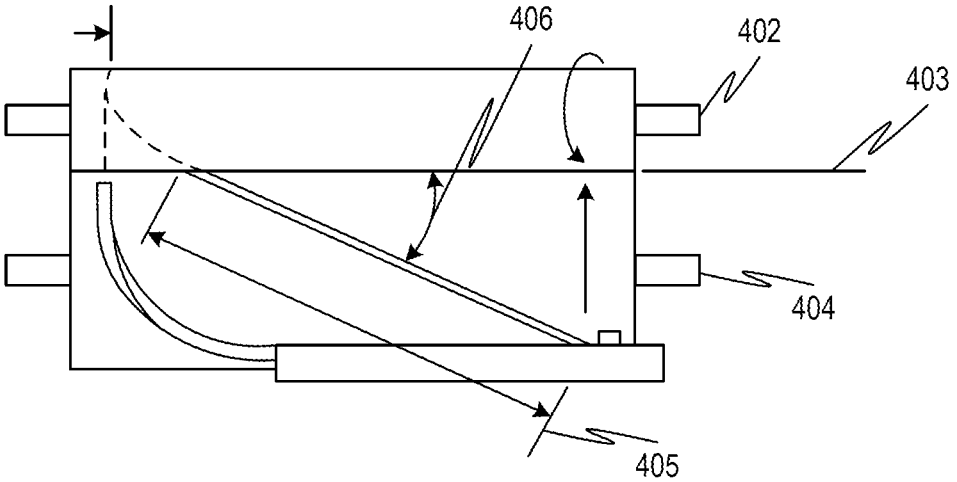
FIG. 4A-4B illustrates aspects of paperband attachment and evolution during turn-up of a paperband along with sensitivities according to some embodiments the present invention.
Figure 4B:
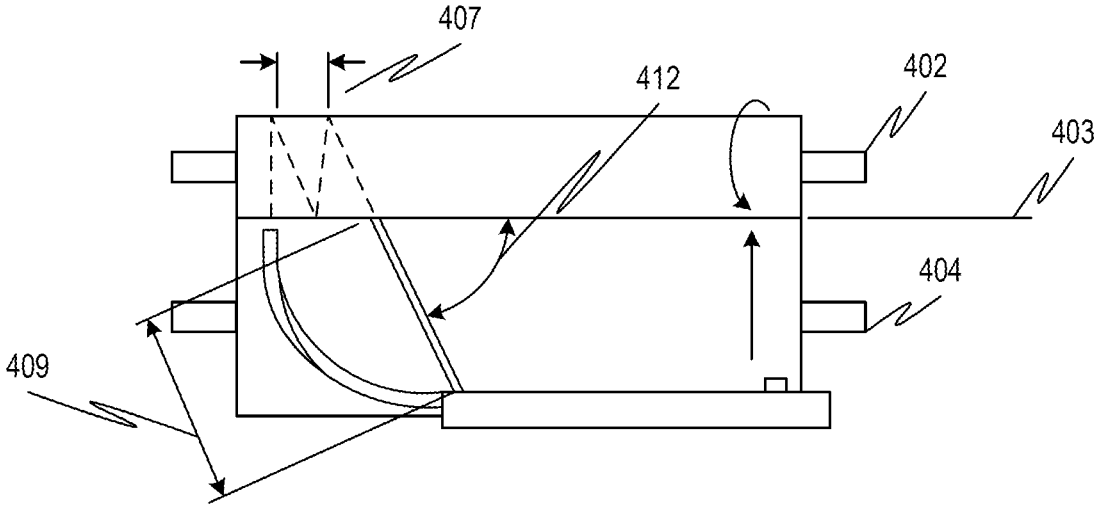

Referring now to FIGS. 4A and 4B, comparison to results from low and high tension are illustrated. For example, in FIG. 4A a low tension condition is illustrated. The spool 402 and the drum 404 may form a nip 403 into which the paperband may be injected at a high angle. With little tension developed on the paperband, the forces generated as the paperband proceeds into the nip may rapidly draw a large free length 405 of the paperband at a low angle 406 until the exited paperband rapidly reaches the brake. Although such conditions may result in smaller amounts of paperband used, the large free length 405 may cause the types of flutter conditions to be enhanced.

Referring now to FIG. 4B, a higher tension example is illustrated. A spool 402 and a drum 404 may form a nip 403 into which a paperband may be injected with conditions to form high tension. The result may be that the angle 412 that the paperband makes as it wraps may be large resulting in smaller spacing between wraps 407. In such an example, the free length of the Paperband 409 may be relatively short and therefore have less propensity to exhibit flutter and the like and its associated failure modes of the turn-up.

These various track component additions which effect control parameters of the exit of the paperband in the track as it is pulled through the nip may help ensure that the paperband is not pulled out at the near edge of the trim. In some examples, the maintenance of the paperband in the track while it proceeds across the width of the paper machine guides the tail portions of the paperband to encourage interleaving of the paperband with accumulating layers of paper on the spool. In some examples, the control of the paperband during turn-up may prevent the tail from whipping wildly around the spool shaft.

In many examples, there may be a force applied by the brake during the turn-up that is important to realize the turn-up. For example, the tension developed as the brake holds the paperband may be important in overcoming the tear resistance of the web. Increasing brake pressure may also hastens the advancing pullout of the paperband across the machine.

In some examples, positioning of the brake along the track near the exit point shortens the length of paperband required by the turn-up. In especially fast paper machines, the friction of the paperband in the track itself, combined with the rate at which the band is consumed by the nip, especially with respect to the designs described herein may be enough to initiate and sustain the turn-up.

In many examples, it may be important to control tension effects in a turn-up Paperband and a rate at which tension upon the paperband can change. Accordingly, the present invention provides for some embodiments in which tension is gradually applied and maintained as consistently as possible throughout a turn-up process.

In some examples, a manner to do this include balancing a multiple variables involved in the turn-up process. In general, the present invention provides for apparatus and methods that control variables involved in the turn-up process. A first variable to be controlled includes a force required to pull the paperband longitudinally through the track which may be reduced by enlarging the band path. In some examples, In some examples, it may also be increased marginally by installing a lead-in track with a hump in it. The magnitude of the hump may be increased until the resulting drag overcomes the dispenser's ability to push the paperband.

In another example, the force required to peel the paperband out of the track may be reduced by widening the throat of the track and-or removing the apron. Alternatively, the force may be increased by adding aprons or installing track tensioning devices that may hold the apron down.

In some examples, controls of the force to pull the paperband through and around the exit point may be affected by the radius the paperband must negotiate. In some examples, the smaller the radius, the greater the force—all other factors remaining the same. In other examples, large radii may add surface area, which may eventually become a factor.

In still further examples, a force required to pull the paperband through the brake may be adjusted by air pressure. However, in practice low pressure adjustments may be impractical due to unreliable performance at low pressures, such as below approximately 20 P.S.I.

Experimentation and analysis performed with various examples as have been described herein demonstrates that in some embodiments of the present invention, operation of turn-up tracks in high speed machines does not require use of the brake function. According to the present invention, under high speed operations of a paper machine, a force to pull a paperband through the dispenser mechanism and through the track may be enough to initiate and propagate the turn-up. Consequently, it may be possible to remove brake drag from the sum of forces by not actuating the brake. This also reduces one change in the developed tension through the duration of the turn-up event, potentially eliminating one cause of paperband breakage.

In studies, applying brake pressure increases the rate of the paperband pull-out which may result in decreasing the angle, and lengthening the uncontrolled span from track to nip, and potentially increasing flutter and twisting. In contrast then, in some examples reducing the brake pressure may decreases the advance of the pullout, increase the angle, and shorten the uncontrolled span of paperband as illustrated previously.

In some examples, increasing the stiffness of a track apron may further slow an advance of the pullout, increase the angle, and shorten the uncontrolled span. However, in some examples increasing the angle, such as to approaching 90 degrees may slow the advance of the pullout across the paper machine and may increase the paper band's tendency to follow the drum grooves. The shallower the angle, which may be adjusted by increasing brake pressure and having a soft apron, the more the condition may hasten the advance of the pullout, which may allow the paperband to overcome the grooves by approaching the nip at a high angle to the circumferential grooves. Again, these conditions may increase the propensity for the paperband to flutter.

Curve Aprons

Additional improvement may be obtained by controlling tension of the paperband during turn-up processing. In some examples, improvement may be obtained by reducing changes in tension throughout the turn-up event. For example, in some examples, improvement may be obtained by continuing the apron along the lower portion of the curve track which could reduce or eliminate the transition in tension from curve pull-out where aprons are typically absent, to track pull-out where aprons are traditionally used. In some examples, a clip that secures the apron to the curve may be used.

Figures 5A, 5B, 5C, 5D:
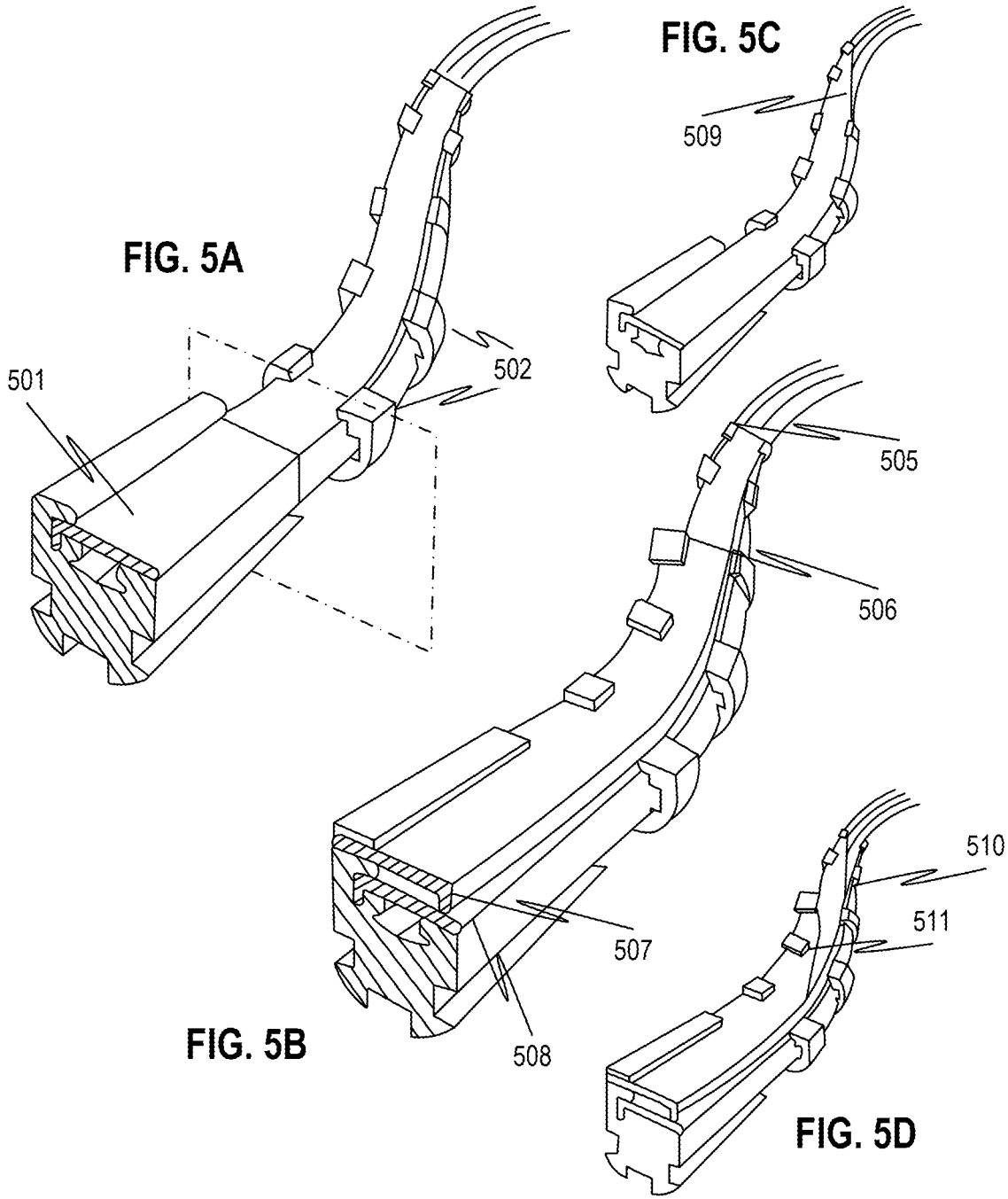
FIGS. 5A-5D illustrate aspects of curve tracks for turn-up tape dispensers according to some embodiments the present invention.

Referring now to FIG. 5A, clips 502 may be used to hold an apron 501 to a curve track. In an example, the clips may be used 3 to 4 inches to have as smooth an effect as possible. Although the clips and the geometry of the curve accommodate only one apron, there may be a second track apron extended along the curve.

Referring to FIG. 5B, a curve track is illustrated with multiple aprons such as a first track apron 508 which may extend to a point 505 and a second track apron 507 which may extend to a point 506.

Referring to FIGS. 5C and 5D the examples may also have an improved transition aspect by cutting the ends of aprons at an angle. In FIG. 5C the example of a single apron may have an angle 509 at the end. And, in FIG. 5D, both aprons may have angles cut out as shown in the angle of the first apron 510 and the angle of the second apron 511.

In many examples, the standard brake mechanism for a turn-up tape distribution system 109 may include an air cylinder with a shoe pressing the paperband against an anvil, which may present a constant effect. For example, in cases where the other aspects of the turn-up system present significantly different degrees of resistance, the constant resistance of the brake may result in a stress when the break becomes activated that could overcome the tensile strength of the paperband, which could result in turn-up failures as have been described. An alternative may be to replace the piston based brake system with an idle wheel and a nip roll. Increasing pressure on the nip roll may increase resistance against pulling the band through the nip. Increasing the mass of the wheel may also increase its resistance to acceleration. The combined effect may smooth the jerkiness in tension as the turn-up process advances through its stages.

The Use of Bars to Minimize the Effect of Flutter

The length of free paperband between the cross-machine track and the drum-spool nip has been discussed, especially in relation to how this distance allows the paperband to twist. A solution to this may be a pair of bars aligned in parallel or near parallel positions. In some examples, the parallel bars may be positioned approximately two-thirds of the distance between the cross-machine track and the drum-spool nip, and lying parallel to the nip.

Figure 6A:
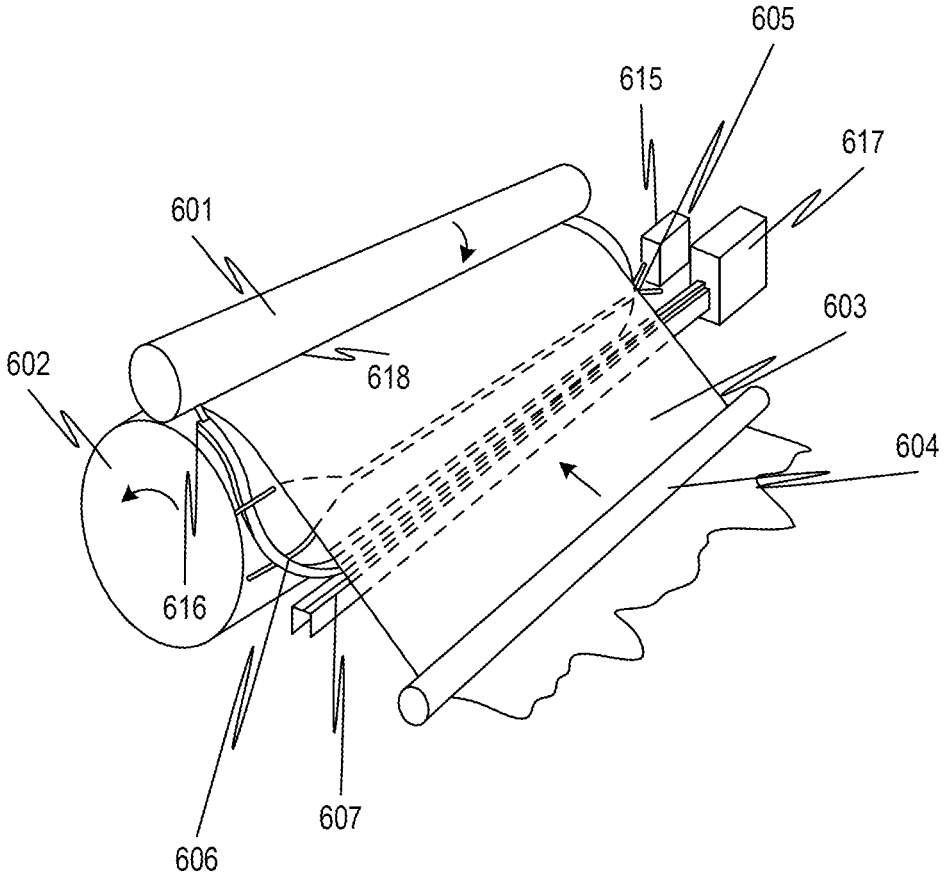

Referring to FIG. 6A the parallel bar example is illustrated. A new web spool 601 and full web spool 602 may be positioned to form a nip 618 into which paperband 617 is injected. The paper web 603 may be advanced along a lead in roller 604. The paperband 617 may be deployed between the parallel bars 605 which may be called tension bars 605. The tension bars 605 may be positioned relative to one another to prevent twisting of the paperband 617 by requiring the paperband 617 to run over the first and under the second tension bars 605, or vice versa. As discussed, preventing the paperband 617 from twisting may reduce the risk of crushing and breaking the paperband in the nip.

In some examples, the distance between, and therefore the resistance presented by, the bars may be adjusted in sequential zones that flow seamlessly from one to the next.

Referring now to FIG. 6B an illustration of tension bars 605 with adjusted sequential zones 607, 608 and 609 which have different distances providing for nearly infinite adjustability to compensate for, augment, or supplant the tension imparted by the system's curve and cross-machine tracks, and the presumably abrupt changes in tension caused by aprons, accessories, exit points and brake mechanism.

The function of the tension bars 605 may be enhanced by the opportunity to install them close to the drum-spool nip, between the frames of the paper machine, whereas the turn-up system dispenser and cross-machine beam must be mounted in a clear path across the entire width of the paper machine.

Referring to FIG. 6C an illustration is made to show the ability to position the bars close to the drum spool nip. A new web spool 601, a full web spool 602 and an advancing paper web 611 is illustrated with a lead in roller 612 for example. The system may include a track 614 with aprons as have been described. A paperband with flutter 613 may pass through the bars 605 which may be at a distance 610 close to the new web spool 601, full web spool 602 nip much closer than other elements of the system.

In other embodiments, a tension bar (see, for example item 605) may be positioned between the cross track 616 and a full web spool 602 and contact a curve track 606 connected to the cross track 616. In some embodiments, a positioning system 615 may be used to adjust a location of the tension bar relative to the cross track 303.

Still further embodiments may include two tension bars 605, at least one of the two bars 605 may be positioned between the cross track 616 and a full web spool 602 such that the curve track 606 is connected to the cross track 616 as it passes between the two bars 605. The two bars may be symmetrically bent in different regions to adjust forces at contact points with the curve track 606 as the curve track 606 interacts with one of the two bars 605.

In some embodiments, the bars may be shaped and positioned to pass above and below the curve track to facilitate the transition of the band path from the track to that defined by the bars. The bars may also be adjusted to present an, irresistible stop to the paper band's advance across the paper machine, acting as a second exit point. In some examples such as in FIG. 6D tension bars 605*a*-605*b* may be positioned such that the leading bar is above second bar. In other examples, such as in FIG. 6E tension bars 605*a*-605*b* may be positioned such that they are relatively even along the path of the paperband. And, in some examples, such as in FIG. 6F a leading bar 605*a* may be below the second bar 605*b*. In some examples, the bars may be mounted immediately adjacent to the cross-machine track.

Figure 7:
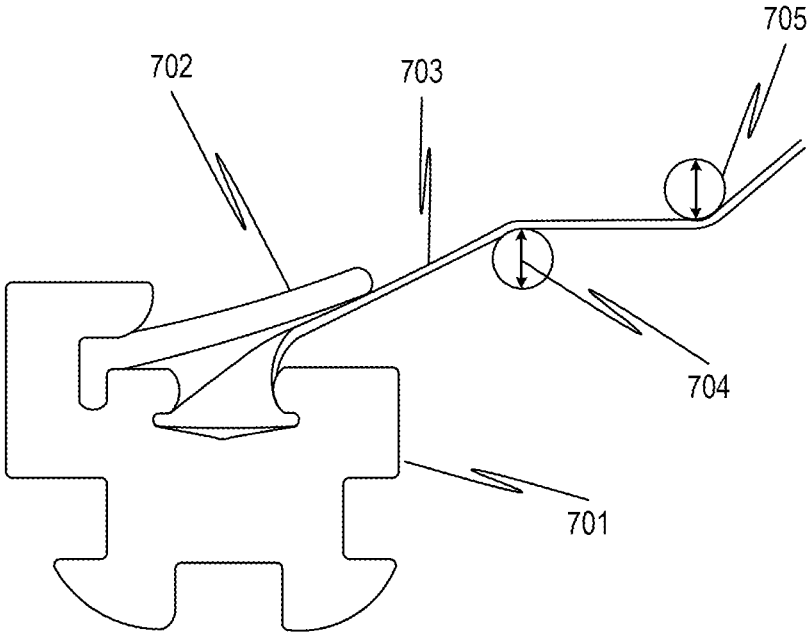
FIG. 7 illustrates aspects of bars and tracks for turn-up tape dispensers according to some embodiments of the present invention.

Referring now to FIG. 7, a track 701 and an apron 702 may control the release of paperband 703. In the near proximity the tension bars 704 and 705 may be located to control the paperband 703 and to serve the purpose of smoothing transitions in tension in cases where the track 701 lies close enough to a drum-spool nip that the track 701 position and other factors mitigate twisting of the paperband 703.

Figure 8A:
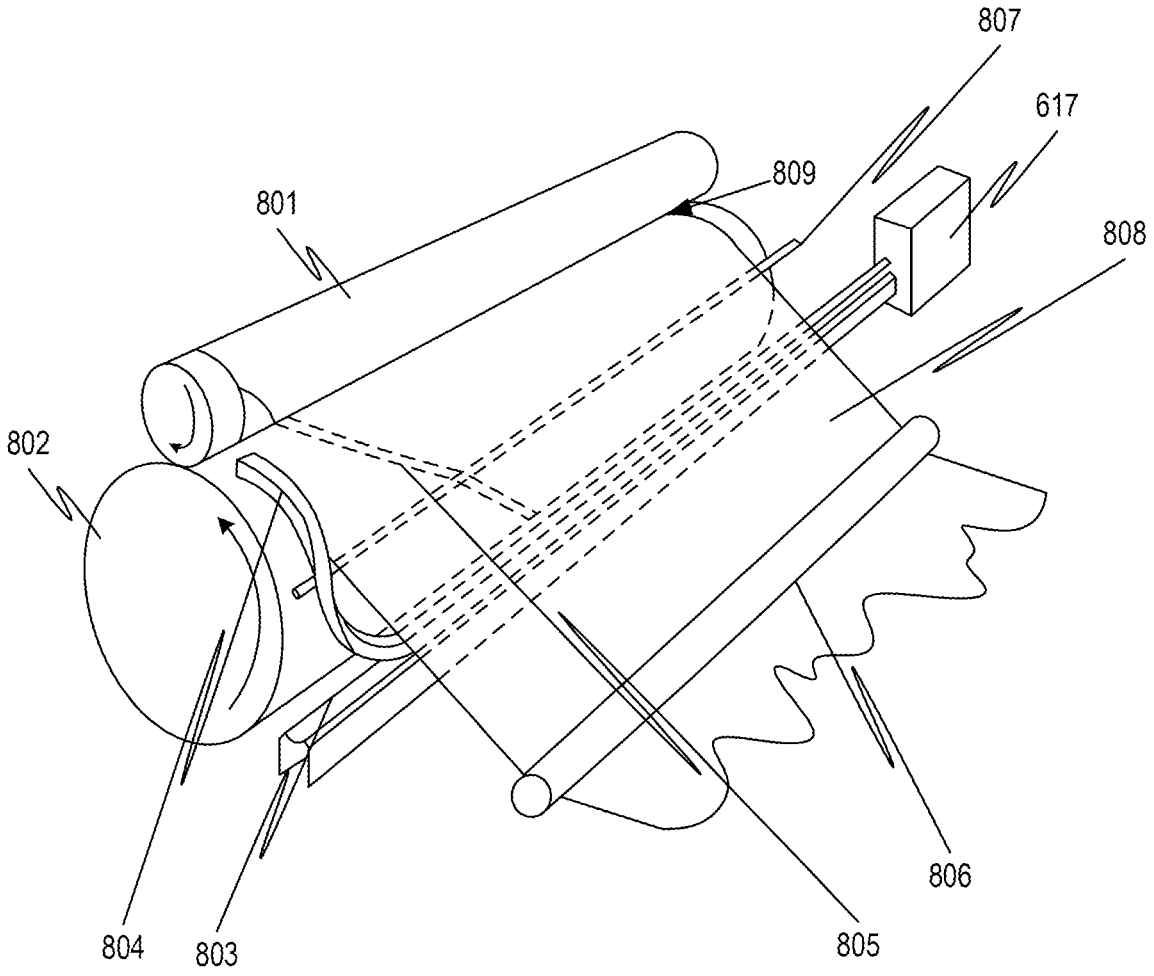
FIGS. 8A-8C illustrate additional aspects of bars and tracks for turn-up tape dispensers according to some embodiments of the present invention.

Referring to FIG. 8A, in some embodiments, a single bar may be placed relatively close and parallel to the spool-drum nip. The curve may be positioned above the bar and the exiting paperband may then run over this bar an empty web spool 801 and full web spool 802 are positioned to create a spool/drum nip 809. In some examples, a cross track 803 and a curve track 804 may be used deploy a paperband 805 until the paperband 805 is injected into the nip 809. A paper web 808 may be driven by the paper making machine and be run into the spool and drum nip position. In some examples, a lead in roller 806 may interact with the paper web 808. In some examples, as illustrated in FIG. 8A the system may include a single bar 807 which may interact with the paperband 805 to help eliminate flutter as well as improve aspects such as tension on the paperband during the turn-up processing.

Figure 8B:
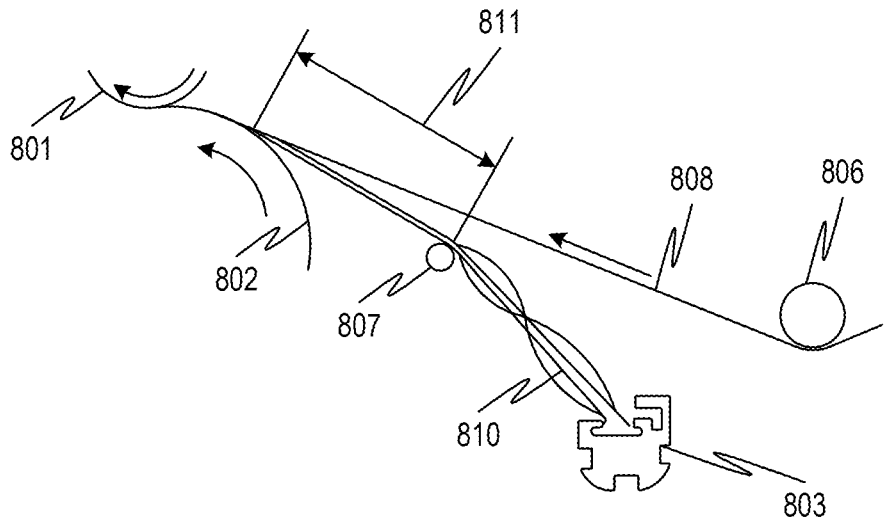
Figure 8C:
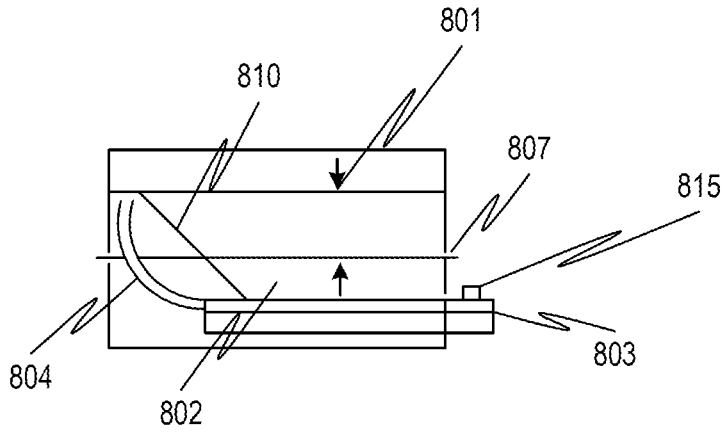

Positioning the bar high enough in the reel section may prevent the paperband from contacting a grooved drum, eliminating the influence of the grooves which may first retard, and then accelerate the advance of the paperband across the web. The bar may also serve as a control point to reduce flutter in the paperband entering the nip. Referring now to FIG. 8B, an empty web spool 801 and full web spool 802 are positioned to create an appropriate spool/drum nip. A single bar 807 may be positioned at a distance 811 very close to the spool/drum nip. A cross track 803 may release the paperband 810 into the spool; drum nip. The paperband 810 may run along and interact with the single bar 807. In some examples, as illustrated the paperband 810 may experience flutter between the cross track 803 and the nip, which may be diminished by interaction with the single bar 807 before it gets close to the nip. In some examples, the paper web 808 may run along a lead in roller 806 as illustrated. Referring to FIG. 8C, the elements are illustrated in a plan view including the empty web spool 801, full web spool 802, cross track 803, end curve track 804, and the paperband 810. As illustrated, the paperband 810 may interact with the single bar 807 as it proceeds through the turn-up. In some examples, the interaction of the paperband 810 with the single bar 807 may introduce tension into the system. Depending on the placement of the single bar 807, in some examples, the tension created may be large enough to dominate other sources of tension in the system which may lead to a more stable total amount of tension as the turn-up process proceeds. As discussed herein, the cross track may have a break 815 or roller device included to create a controllable amount of tension on the paperband end.

The various examples have described a cross track, also called a cross machine track, or track to distribute the paperband tape. There may be numerous designs that may be consistent with the various examples herein. In one type of examples, the cross machine track may be formed of a metallic base. In some examples, these metallic cross track bodies may be formed of extruded aluminum. In some examples, the cross track body may be formed as a composite of extruded aluminum and plastic such as in a non-limiting example polyurethane, UHMW polyurethane or other high strength plastics. It may be important that the surfaces that a paperband would slide upon may have a controlled friction aspect which may be either being smooth or alternatively roughened.

An environment in which a paper making machine is located may have high levels of particulates, particles, fibers, humidity and other environmental constituents that can affect consistency of operation the various examples of cross tracks may include gaseous purging flows which may pressurize portions of the track. As outlined in previous sections, the tracks may include aprons to cover the top of the track. They may be involved in keeping the pressurization within the paperband area of the cross track. In some examples, the formed cross track body may include slots, clamps with attachment features or the like to hold the one or more aprons onto the cross track. In some examples, the pressurized air may provide a cushion that the paper bands may ride upon for smooth operation. These various aspects of the cross track may be included in the various examples.

Figure 9:
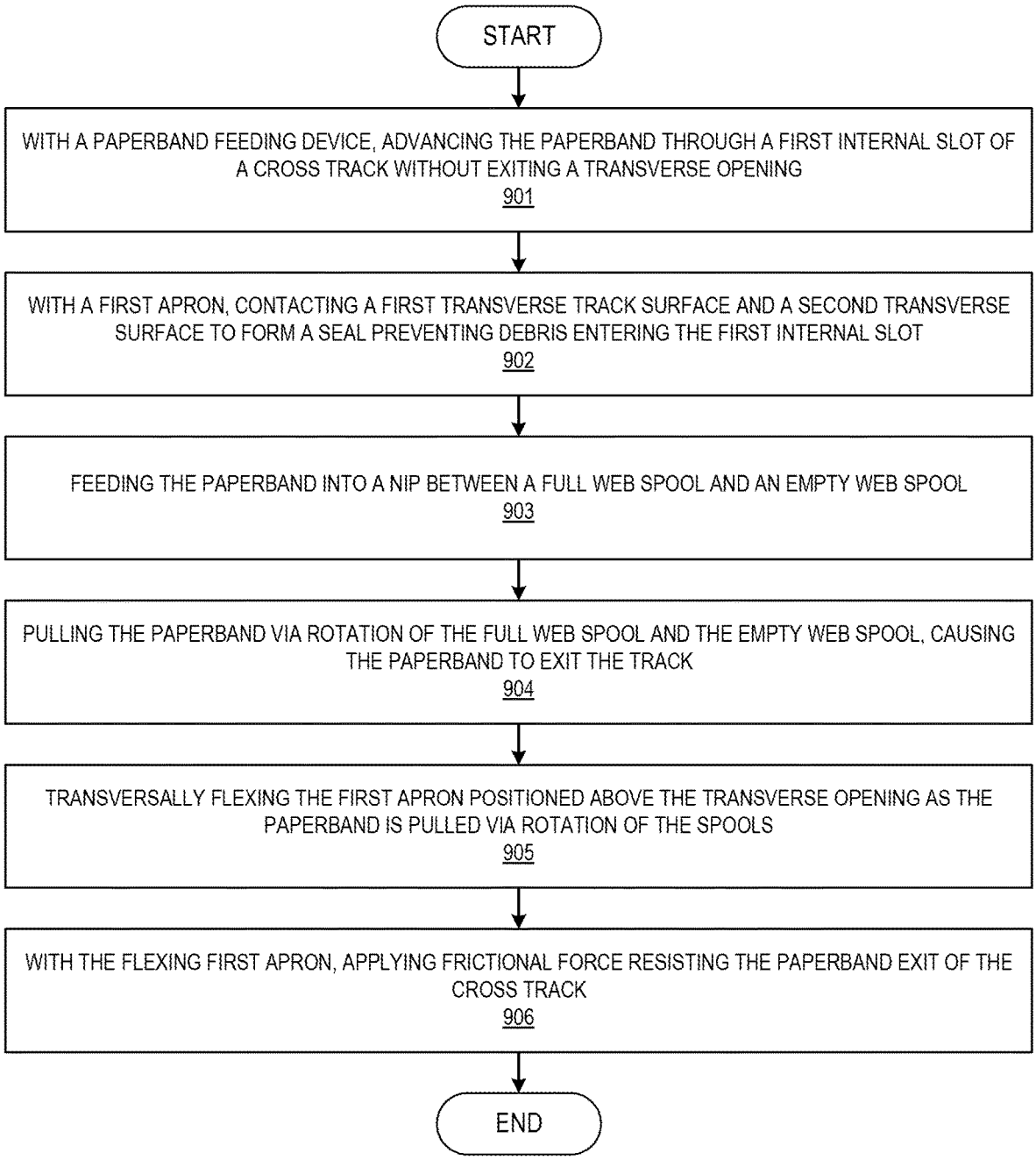
FIG. 9 illustrates method steps that may be performed in some embodiments of the present invention.

Referring now to FIG. 9, a flowchart is illustrated that describes a method of deploying a paperband, according to some embodiments of the present disclosure. At step 902, the method may include, with a paperband feeding device, advancing the paperband through a first internal slot of a cross track without exiting a transverse opening included in the cross track. At step 902, the method may include, with a first apron, contacting a first transverse track surface and a second transverse surface to form a seal preventing debris entering the first internal slot through the transverse opening.

In some embodiments, At step 903, the method may include feeding the paperband into a nip between a full web spool and an empty web spool.

At step 904, the method may include pulling the paperband via rotation of the full web spool and the empty web spool, causing the paperband to exit the cross track via a transverse opening.

At step 905, the method may include transversally flexing the first apron positioned above the transverse opening as the paperband is pulled via rotation of the full web spool and an empty web spool.

At step 906, the method may include applying frictional force resisting the paperband exit of the cross track.

In some embodiments, the step of inflating a bladder and applying pressure to the first apron with the inflated bladder. In some embodiments, the step of applying pressure to the first apron with a second apron. In some embodiments, the step of securing the second apron in position above the first apron with a bracket. In some embodiments, the step of securing the first apron in position relative to the transverse track via a slot in the cross track.

While the invention has been described in conjunction with specific embodiments, it is evident that many alternatives, modifications, and variations will be apparent to those skilled in the art in light of the foregoing description. Accordingly, this description is intended to embrace all such alternatives, modifications and variations as fall within its spirit and scope.

What is claimed is:

1. An apparatus for deploying a paperband for a turn-up operation on a paper making machine, the apparatus comprising:

a cross track comprising a first internal slot in which the paperband may be extended to prepare for a turn-up procedure on the paper making machine, and a transverse opening through which the paperband may be deployed;

a first apron positioned above the transverse opening and contacting a first transverse track surface and a second transverse track surface, to form a seal against debris entering the transverse opening, said first apron transversally flexible in response to the paperband exiting the first internal slot and being removed from the cross track during the turn-up operation, said first apron applying frictional force resisting the paperband exiting the cross track;

a curve track holding the paperband at an angle to an axis of the cross track;

a paperband feed operative to advance the paperband through the first internal slot without exiting the transverse opening; and a bladder positioned above the first apron and beneath a fixed surface, wherein the bladder is resistant to compression such that movement of the first apron against the bladder results in pressure generally normal to a top surface of the first apron.

2. The apparatus of claim 1, additionally comprising an attaching feature to affix the first apron across the transverse opening.

3. The apparatus of claim 2 wherein the attaching feature comprises an apron holding slot along a length of the cross track, the first apron comprising a portion that fits within the apron holding slot.

4. The apparatus of claim 2 additionally comprising a bladder positioned above the first apron, and the attaching feature comprises an apron holding slot in the cross track, the first apron comprising a body that fits within the apron holding slot, and the bladder contacting at least a portion of the first apron.

5. The apparatus of claim 1, additionally comprising an apron tensioning device providing an additional force generally normal to an upper surface of the first apron.

6. The apparatus of claim 1 additionally comprising a second apron affixed to the cross track and contacting the first apron thereby providing additional tension to the paperband when the paperband exits the cross track and contacts a surface of the first apron.

7. The apparatus of claim 1 additionally comprising a gas control system in fluid communication with the bladder, the gas control system capable of providing pressurized gas to the bladder and control an inflation status of the bladder.

8. The apparatus of claim 1 additionally comprising a gas control system in fluid communication with the bladder to control an inflation status of the bladder.

9. The apparatus of claim 1 additionally comprising a tension bar positioned between the cross track and a full web spool and contacting a curved track connected to the cross track.

10. The apparatus of claim 9 additionally comprising a positioning system to adjust a location of the tension bar relative to the cross track.

11. The apparatus of claim 1 wherein the cross track additionally comprises a gas system to pressurize at least a portion of the cross track that supports the paperband.

12. An apparatus for deploying a paperband for a turn-up operation on a paper making machine, the apparatus comprising:

a cross track comprising a first internal slot in which the paperband may be extended to prepare for a turn-up procedure on the paper making machine, and a transverse opening through which the paperband may be deployed;

a first apron positioned above the transverse opening and contacting a first transverse track surface and a second transverse track surface, to form a seal against debris entering the transverse opening, said first apron transversally flexible in response to the paperband exiting the first internal slot and being removed from the cross track during the turn-up operation, said first apron applying frictional force resisting the paperband exiting the cross track;

a curve track holding the paperband at an angle to an axis of the cross track;

a paperband feeding device operative to advance the paperband through the first internal slot without exiting the transverse opening;

two bars, at least one of the two bars positioned between the cross track and a full web spool such that a curved track connected to the cross track passes between the two bars wherein the two bars are symmetrically bent in different regions to adjust forces at contact points with the curved track as it interacts with one of the two bars.

13. An apparatus for deploying a paperband for a paper machine turn-up operation, the apparatus comprising:

a cross track comprising a first internal slot for the paperband to move upon and an attaching feature to affix a first apron to a surface proximate to the first internal slot;

the first apron, wherein the first apron lies across the surface above a location for the paperband, and wherein the first apron interacts and contacts the paperband when it is pulled out of the apparatus during the paper machine turn-up operation;

an apron tensioning device, wherein the apron tensioning device provides an additional force against at least an edge of a surface of the first apron, wherein the apron tensioning device comprises a bladder, wherein the bladder is molded to the first apron, and wherein the attaching feature comprises an apron holding slot along a length of the cross track, wherein the first apron comprises a portion of its body that fits within the apron holding slot, and wherein the bladder contacts at least a portion of the first apron and applies additional tension to the paperband when the paperband exits the cross track;

a curve track, wherein the curve track holds the paperband at an angle to an axis of the cross track;

a paperband feeding device; wherein the paperband feeding device advances the paperband during at least an initial portion of a turn-up operation;

a pair of bars, wherein the pair of bars has a length approximately equal to a length of a spool of a paper making machine, and wherein the pair of bars is positioned to be between the cross track and the spool of the paper making machine such that the paperband passes between the pair of bars as the paperband is drawn through a nip; and wherein the pair of bars are symmetrically bent in different regions to adjust forces on the paperband as it interacts with at least one bar of the pair of bars.

14. A method of deploying a paperband for a paper machine turn-up operation, the method comprising the steps of:

a. with a paperband feeding device, advancing the paperband through a first internal slot of a cross track without exiting a transverse opening included in the cross track;

b. with a first apron, contacting a first transverse track surface and a second transverse track surface to form a seal preventing debris entering the first internal slot through the transverse opening;

c. feeding the paperband into a nip between a full web spool and an empty web spool;

d. pulling the paperband via rotation of the full web spool and the empty web spool, causing the paperband to exit the cross track via the transverse opening;

e. transversally flexing the first apron positioned above the transverse opening as the paperband is pulled via rotation of the full web spool and the empty web spool;

f. with the flexing first apron, applying frictional force resisting the paperband exit of the cross track; and g. inflating a bladder and applying pressure to the first apron with the inflated bladder.

15. The method of claim 14 additionally comprising the step of applying pressure to the first apron with a second apron.

16. The method of claim 15 additionally comprising the step of securing the second apron in position above the first apron with a bracket.

17. The method of claim 16 additionally comprising the step of securing the first apron in position relative to the first transverse track surface and the second transverse track surface via a slot in the cross track.

* * * * *